US006281852B1

(12) United States Patent
Amarillas

(10) Patent No.: US 6,281,852 B1
(45) Date of Patent: Aug. 28, 2001

(54) INTEGRATED ANTENNA FOR SATELLITE AND TERRESTRIAL BROADCAST RECEPTION

(76) Inventor: Sal Amarillas, 6048 Cornerstone Ct. West, Ste E, San Diego, CA (US) 92121

( * ) Notice: Subject to any disclaimer, the term of this patent is extended or adjusted under 35 U.S.C. 154(b) by 0 days.

(21) Appl. No.: 08/805,222

(22) Filed: Feb. 24, 1997

Related U.S. Application Data

(63) Continuation-in-part of application No. 08/410,907, filed on Mar. 27, 1995, now Pat. No. 5,606,334.

(51) Int. Cl.[7] ..... H01Q 21/00
(52) U.S. Cl. ..... 343/725; 343/840; 343/909
(58) Field of Search ..... 343/753, 754, 343/725, 727, 909, 911 R, 840, 785, 912, 914, 916

(56) References Cited

U.S. PATENT DOCUMENTS 4,513,293 * 4/1985 Stephens ..... 343/914
4,673,945 * 6/1987 Syrigos ..... 343/755
4,769,646 * 9/1988 Raber et al. ..... 343/753
4,804,970 * 2/1989 Todd ..... 343/909
4,825,223 * 4/1989 Moore ..... 343/840
5,300,936 * 4/1994 Izadian ..... 343/727

* cited by examiner

*Primary Examiner*—Don Wong
*Assistant Examiner*—Tho Phan
(74) *Attorney, Agent, or Firm*—Donn K. Harms

(57) ABSTRACT

An antenna that concurrently provides both satellite and local VHF-UHF radio and television reception. The satellite antenna is comprised of plastic or other radio wave transparent material having a radio wave reflective outfacing surface thereon shaped to reflect incoming satellite signals to a defined focal point. Channels formed in the radio wave reflective material define one or more leg elements for omni directional reception of local VHF/UHF signals eliminating the need and cost to install a separate antenna for local television and radio reception.

21 Claims, 8 Drawing Sheets

INTEGRATED ANTENNA FOR SATELLITE AND TERRESTRIAL BROADCAST RECEPTION

This application is a Continuation-in-part application from application Ser. No. 08/410,907, Mar. 27, 1995, U.S. Pat. No. 5,606,334.

BACKGROUND OF THE INVENTION

1. Field of the Invention

This invention relates generally to radio wave communications, antennae, and more specifically to a reflector antenna for satellite signal reception as well as local radio and television reception.

2. Description of Related Art

Typical direct broadcast satellite (DBS) reception systems currently employ parabolic dish antennas that are both bulky and not aesthetically pleasing. Furthermore, these systems are not able to receive radio and TV signals of local origin. In order to improve the aesthetic character of satellite antenna systems, low profile or "flat-dishes" have been developed; however, previous low profile DBS antennas have been deficient in important RF performance parameters such as, for example, gain, low sidelobes, high cross-polarization solation, and also in necessary mechanical features such as structural integrity and light weight. These devices, due to their complexity, have not been able to be produced at the low cost required for broad commercial success.

As an example of the foregoing, attempts continue in the development of a low profile, high gain flat antenna to achieve acceptable satellite TV signals. Various flat antenna designs using printed circuit, Fresnel zone reflectors and phased array antenna technologies have been tried. Printed circuit flat antennas are limited in bandwidth, aperture efficiency, cross polarization isolation and have high manufacturing costs. Flat phased array antenna designs exhibit very low aperture efficiency, typically in the range of approximately 30–37% versus a high of 70% for an off-set parabolic dish antenna. This type of antenna design also exhibits very poor cross-polarization isolation and high production costs. Fresnel zone plate antennas, which are essentially flat, have not been able to adequately meet all the previously mentioned antenna parameters. The most important limitations of these antennas are primarily related to the above-mentioned loss of performance and poor gain.

A flat antenna is disclosed in *C100: Tsiger Planar Antenna* a technical description from Tsiger Planar Inc. of Colorado Springs, Colo. This device is 65 inches square by only 2.5 inches in thickness, and weighs 65 pounds. It is a combination Fresnel lens and zone plate of a design not yet disclosed nor having patents issued. Further, of interest in the matter of flat antennae is an article entitled, *The New Age of Earth Station Technology* published in *Via Satellite*, May 1994. No prior art has been found which discloses a combination of multi-stepped reflectors, axis fed, lens corrected splash plate feed with VHF/UHF antenna combined elements for the simultaneous reception of satellite and local station off-air broadcast signal reception of high quality.

The present invention fulfills these needs and provides further related advantages as described in the following summary.

SUMMARY OF THE INVENTION

The invention is a combination satellite and local broadcast receiving antenna. It comprises a satellite wave reflector, a feed assembly, a satellite low noise amplifier, and a local broadcast VHF-UHF antenna and a low noise amplifier.

A principal object of the invention is to provide a low profile, flat and compact antennae especially or an improved conventional parabolic dish satellite antenna suited to DBS reception with improved cross polarization isolation, low sidelobes, high gain efficiency, low cost, high reliability and low susceptibility to RF interference.

A further object of the invention is to provide such a satellite antenna with the additional capability of receiving VHF-UHF broadcasts of terrestrial origin.

These and other objectives are achieved by providing a multi-stepped reflector antenna which provides optimal results in individually focusing the incoming satellite parallel rays to a common focal point, while assuring that all reflections are in phase. The reflector consists of multiple parabolic reflective surfaces, all of which are arranged for radiating in phase using one wavelength stepped transitions. These transitions are the phase corrections required to focus each surface to a common focal point. The phased matched steps between the reflecting surfaces are the basis for improved efficiency in the design. The use of step-chokes or quarter wave chokes incorporated in the shadow areas between successive surfaces, control edge scattering in each successive reflecting surface. They reduce electromagnetic energy scattering at the step discontinuities, thereby improving the overall reflection efficiency. The one half wavelength steps provide immunity to terrestrial interference. Various types of corrections are feasible with this antenna. These include satellite and transponder distortion characteristics, satellite propagation characteristics, frequency compression digital coding characteristics and time delay distortion.

A Cutler feed is used in the invention as a mode converter. It changes the direction of the wave returning it to the reflector so as to control the pattern of the feed. A dielectric insert reduces the size of the aperture of the waveguide by dielectric loading. The reduced waveguide and splash plate size, reduces the size of the dead zone at the center of the main reflector. A dielectric lens provides additional efficiency of collection of the reflector. The waveguide can carry either vertically or horizontally polarized energy, or it can carry both polarizations simultaneously to obtain any sense or orientation of received polarization. The feed has excellent cross-polarization isolation and is optimized for the aperture area which preferably uses a 4–10 decibel selectable edge taper and provides equal E-plane and H-plane illumination. The feed and wave guide assembly interfaces directly with a satellite low noise amplifier (LNA) positioned behind the reflector. It provides for polarization selection and optimization, and also alignment through selection of components and by simply rotating the feed assembly within the stationary reflector. The local VHF-UHF LNA provides active summing of the individual off-the-air antenna elements and increases the systems gain-to-temperature ratio to improve off-the-air reception of local broadcast stations.

The performance of the rectangular relatively flat satellite antenna combined with an antenna for local VHF-UHF broadcast reception was of such a success in increased performance over conventional satellite dishes that further improvements were achieved subsequent to the initial successful development. By placing the legs to the VHF-UHF antenna on the outfacing surface of the satellite reflector better omni directional reception was achieved along with the capability to vary the lengths and number of legs to both increase bandwidth reception and customize for local reception in different geographical locations where different frequencies in radio and television signals might be desired. Further, by carrying the VHF-UHF antenna legs upon, or formed into, the satellite transmission reflective surface located upon a satellite wave reflector body formed of a non conductive radio wave transparent material such as fiberglass, plastic, ceramic, or other such materials which are relatively transparent to the passing of VHF-UHF broadcast signals, greater omni directional characteristics are achieved in the VHF-UHF antenna legs. Concurrently, greater capability to vary the length and number of antenna legs is achieved by the ability to use the microwave reflective surface to also form one or a plurality of VHF-UHF antenna legs for local omni directional reception of television and radio signals. Additionally, these improvements can also be used to manufacture conventional round parabolic dish style satellite antennas which will concurrently receive local VHF-UHF signals with all of the same benefits of variable length and number of antenna legs for reception of the desired radio and television spectrum. Heretofore conventional DBS parabolic satellite dish antennas have been made of metal, metal impregnated fiberglass or other such conductive material and solely used to focus satellite signals to a focal point eliminating the ability to form a dual purpose antenna from a single satellite antenna.

As such, this improved design yields great increases in the functionality of rectangular relatively flat as well as round parabolic conventionally shaped satellite dish antennas providing concurrent reception of both satellite signals and omni directional reception of local broadcast VHF-UHF signals from the same antenna. It further yields great increases in the ability to vary the number and length of VHF-UHF antenna legs for optimum reception in a given locale.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the invention. In such drawings.

DETAILED DESCRIPTION OF THE PREFERRED EMBODIMENTS

Figure 1:
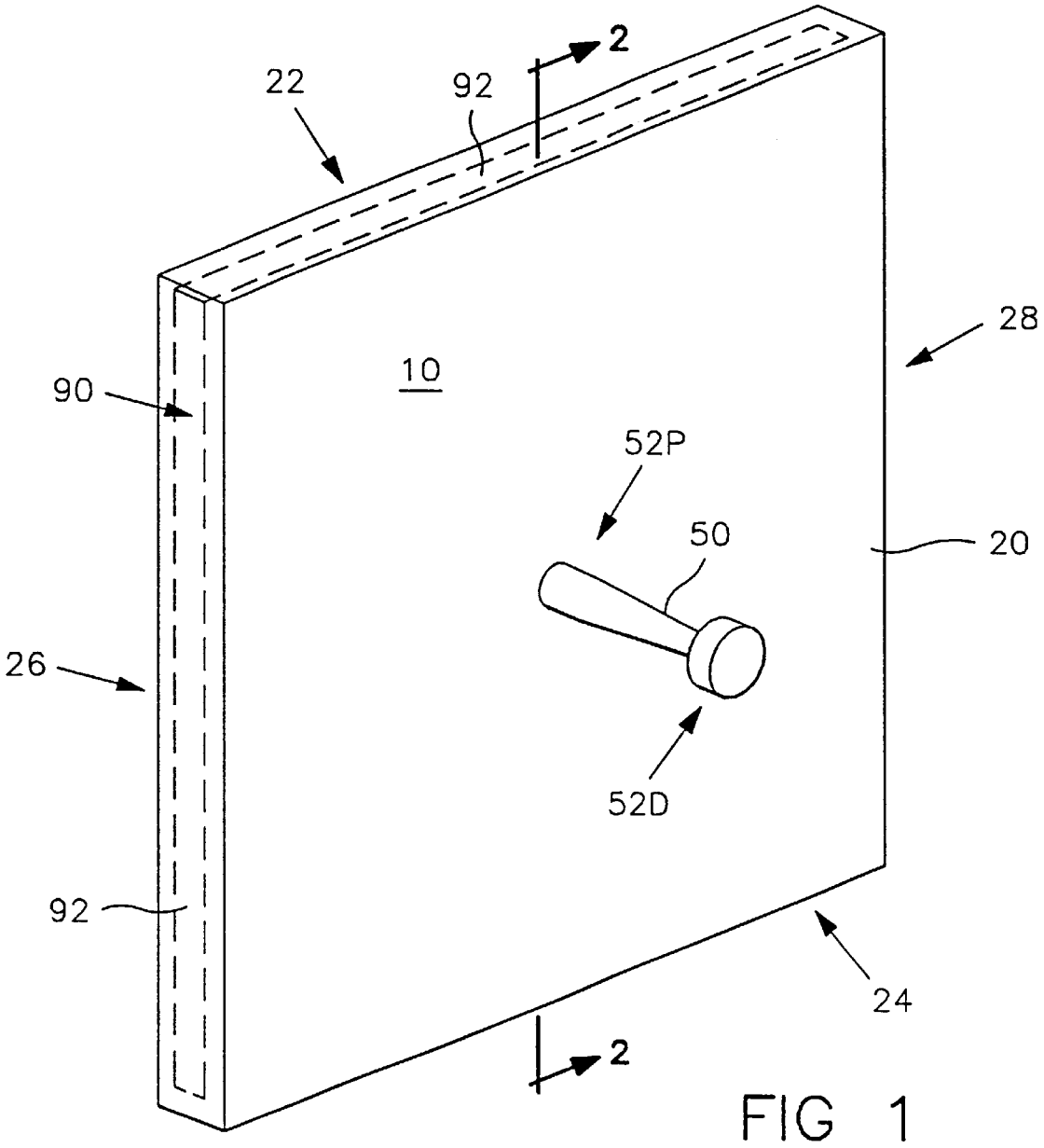
FIG. 1 is a perspective view of a preferred embodiment of the present invention, particularly showing a flat wave energy reflector, and feed assembly.

FIGS. 1–11 show an integrated antenna system designed to provide a low profile, relatively flat and compact antenna especially suited to Direct Broadcast Satellite reception, as well as receiving broadcasts of terrestrial origin. The present inventive integrated antenna system has improved cross polarization isolation, low sidelobes, high gain efficiency and low susceptibility to Radio Frequency interference. It has a size significantly more compact than standard parabolic dish antenna systems, thus making it more aesthetic, more practical and less expensive to manufacture. The present system is highly reliable and much more efficient than standard systems.

The antenna system generally consists of a low profile satellite wave reflector 20, a round waveguide 50, a splash plate 60 and dielectric lens assembly 70, means for satellite signal amplification 80 and a VHF-UHF noise amplifier 85.

Figure 3:
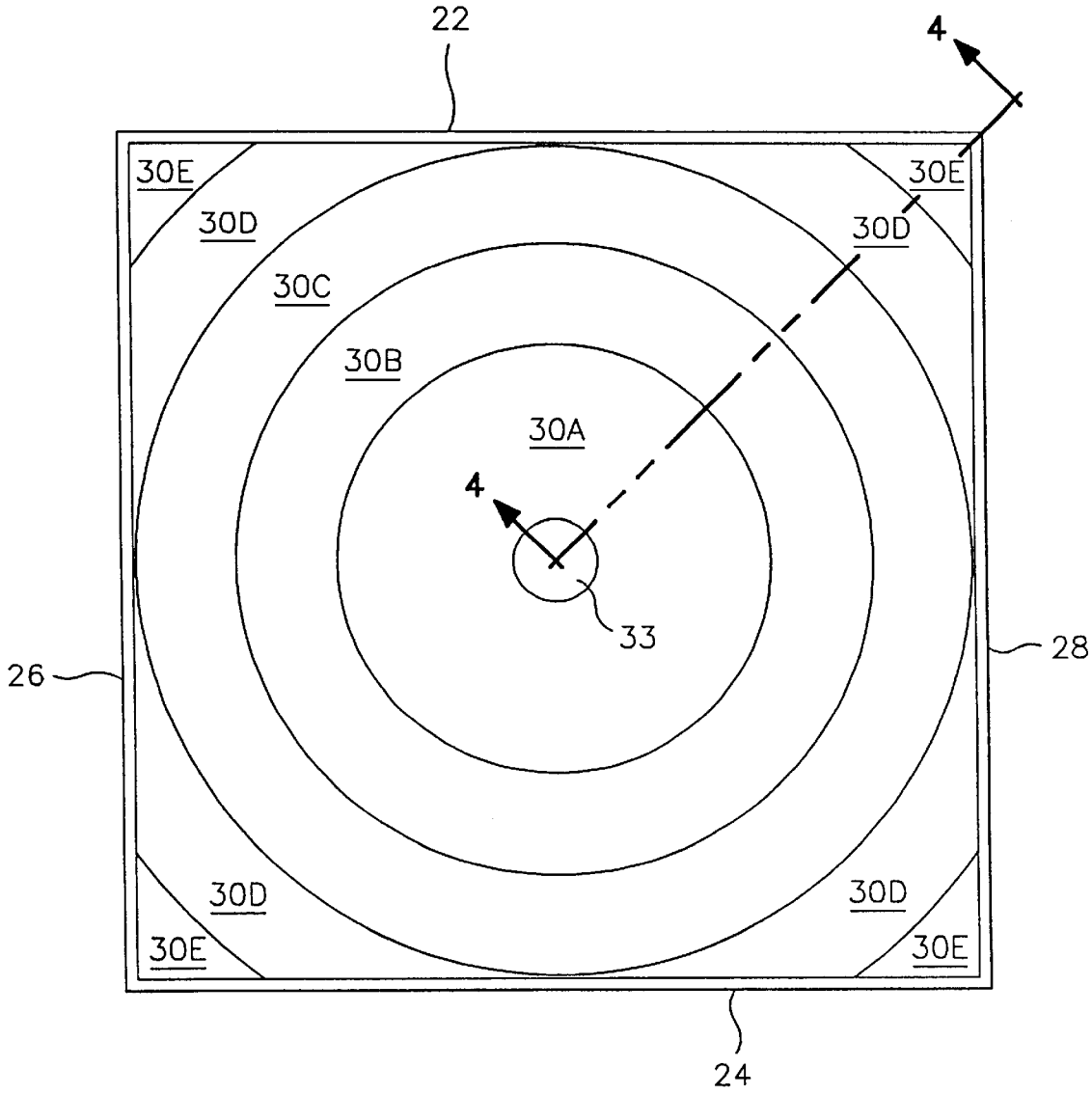
FIG. 3 is a front elevational view of the reflector shown without the cover plate and the feed assembly, particularly showing the positions of concentric parabolic surfaces of the invention.
Figure 4:
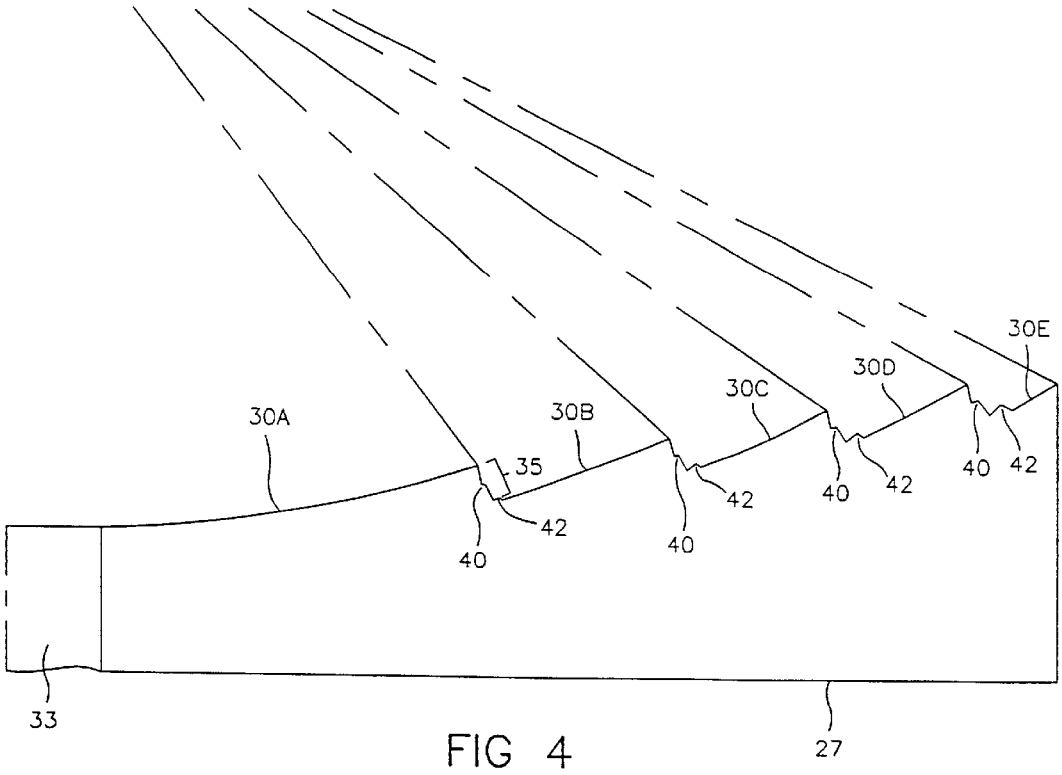
FIG. 4 is a cross-sectional view taken along line 4—4 of FIG. 3 particularly showing a preferred arrangement of concentric reflective surfaces in accordance with the principals of the invention, and further showing a preferred arrangement of quarter wave chokes defined between the surfaces.
Figure 5:
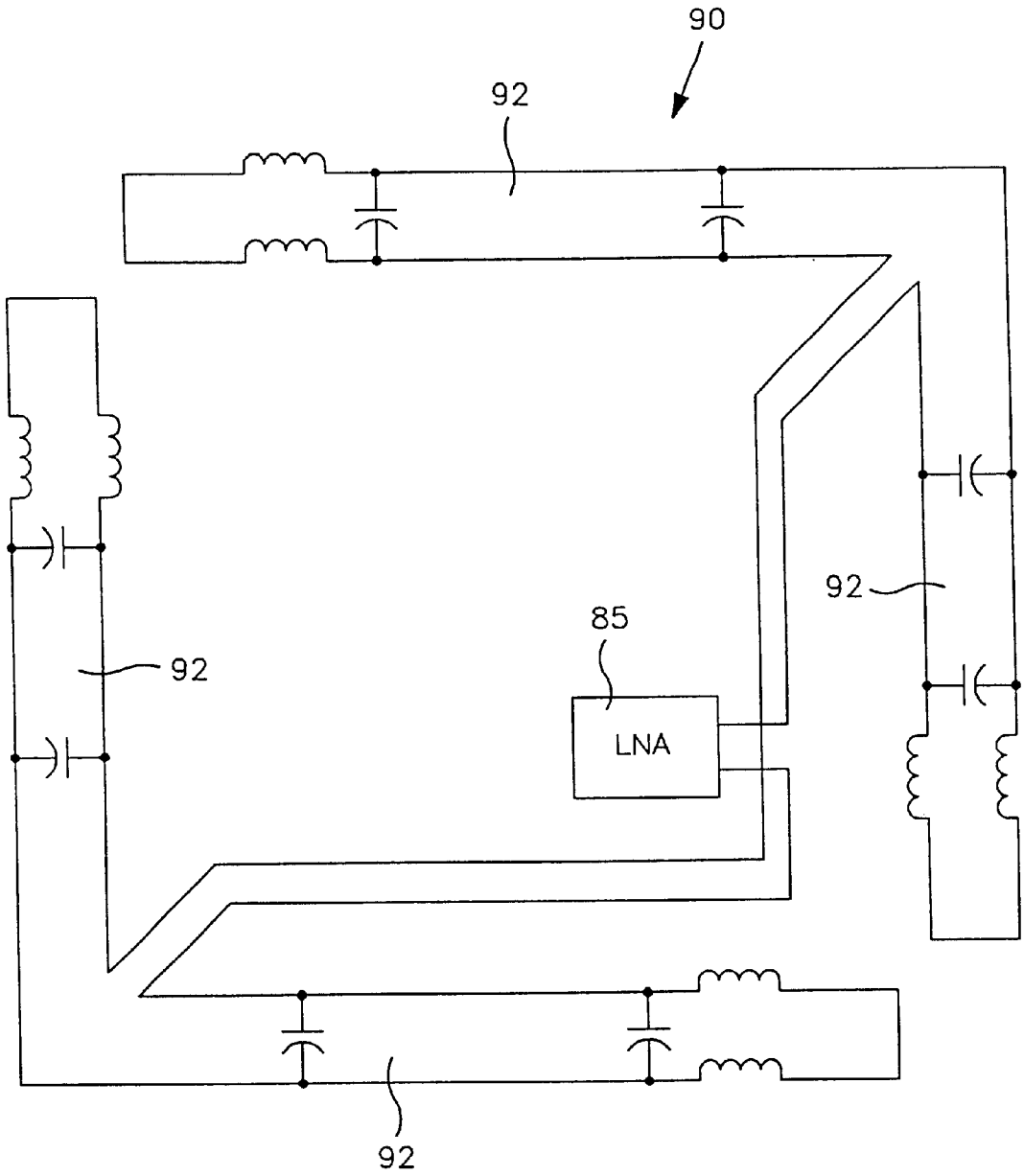
FIG. 5 is an electrical schematic diagram of a local radio and TV reception antenna of the invention, mounted at the edges of the reflector.

As illustrated in FIG. 1, the low profile reflector 20 is relatively square in shape and provides a top 22, a bottom 24, a left 26, and a right edge 28 which define the lateral extent of the reflector 20. The reflector 20 also provides a composite outfacing surface 25 and infacing surface 27. The infacing surface 27 is generally flat, while the outfacing surface 25 is composed of a series of microwave reflecting concentric, circular, near-abutting, parabolic subsurfaces 30A–E which are best seen in FIG. 3. As illustrated, the reflector 20 includes five parabolic subsurfaces 30A–E, but the reflector is by no means limited to this number of subsurfaces. Micro wave reflection on conventionally used concave parabolic satellite dish antennas for DBS reception is accomplished using metal for the body of the satellite wave reflector 20 or by using metalized fiberglass material where powered metal is added to resin mix during manufacture enabling the finished fiberglass antenna to reflect electronic signals. These embodiments feature fiberglass, plastic, glass, polyethylene, polypropylene, or other materials that are substantially transparent to radio waves of conventionally used frequencies for television, commercial radio and satellite broadcasts, forming the body of the wave reflector 20. A metalized coating of copper or other metalized paint is located upon an outfacing surface 25 to achieve the required microwave and radio wave reflection. Additional weatherability against possible oxidation of the metalized surface may be achieved by application of a coat of weather resistant material such as polyurethene. In order to achieve the required microwave reflection of the satellite wave reflector 20, metalized film, powder coatings, or other microwave and satellite signal reflecting material can also be located onto the outfacing surface 25 to achieve desired reflection characteristics. Depending on the end cost of the product, desired resulting reflection and economies of scale in manufacturing, differing metalized and other reflective materials are anticipated.

Figure 2:
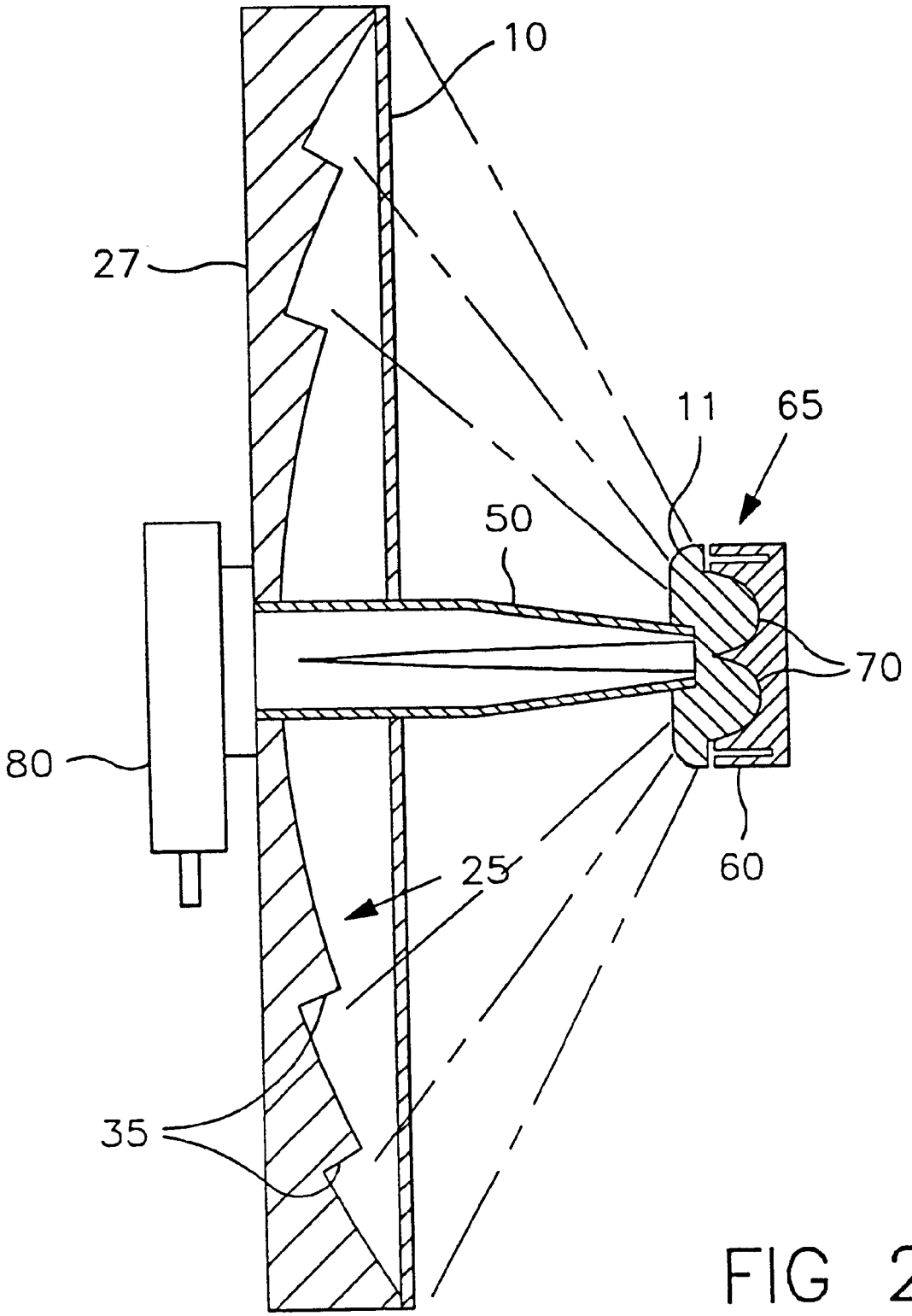
FIG. 2 is a cross-sectional view taken along line 2—2 of FIG. 1 providing further details of the invention.

Each subsurface 30A–E is separated from each adjacent subsurface by an annular step 35 (FIG. 2). This configuration effectively positions the subsurfaces 30A–E in a relatively flat arrangement. Each of the parabolic subsurfaces is an annular section of a parabolic dish, and each is shaped and positioned so as to define a common focal point for the reflector 20 as a whole. The multi-stepped reflector 20 combines both diffraction and refractive principles to collimate RF signal waves to a short focal point. The focal distance of the subsurfaces is significantly shorter than a comparable focal distance for a continuous parabolic dish antenna of comparable diameter.

Each annular step 35 includes at least one annular substep 40 positioned at a quarter wavelength position (FIG. 4) The substep 40 provides a choke incorporated in the shadow areas between the reflecting surfaces that serves to control and reduce edge scattering in each successive reflecting subsurface. The substeps 40 reduce electromagnetic energy scattering in the annular steps 35, thus improving the overall reflection efficiency of the reflector 20. The suppression of terrestrial interference is provided by a set of additional substeps 42.

The height of each annular step 35 is equal to one wavelength of the carrier wave of the satellite signal. Thus, each two adjacent parabolic subsurfaces are separated by one wavelength of the carrier wave so that the parabolic reflective subsurfaces 30 A–F radiate in phase using one wavelength stepped transitions. These transitions are the phase corrections required to focus each reflecting surface to a common focal point. Ultimately then, the phased matched steps 35 between the reflecting surfaces are the basis for improved efficiency in the present inventive design. Whereas flat antennas may have only 30% reflection efficiency, the present integrated antenna system has approximately 60% efficiency.

The reflector 20 has a centrally located through hole 33, as best illustrated in FIG. 3. The hole is of a size and shape to allow the round waveguide 50 of the integrated antenna system to be inserted through the hole 33. The waveguide 50 has a proximal 52P and distal end 52D. As illustrated in FIG. 1, the proximal end 52P of the waveguide 50 is positioned in the hole 33, the waveguide 50 thus secured to the reflector 20 at a position central to the subsurfaces 30A–E while the open, distal end 52D of the waveguide 50 extends outwardly from the outfacing surface 25 of the reflector 20.

The splash plate 60 and the dielectric lens 70 assembly function as a feed system 65 of the invention. As best illustrated in FIG. 2, they are attached to the distal end 52D of the waveguide 50 in a position so as to intercept radio waves reflected in phase by the reflector 20 toward the focal point. Once they are intercepted, the dielectric lens 70 directs the radio waves into the waveguide 50. The waveguide 50, as is usual for common waveguides, can carry either vertically or horizontally polarized energy, or it can carry both polarizations simultaneously to obtain any sense or orientation of received polarization.

The waveguide 50 interfaces directly with the means for satellite signal amplification 80. The amplifier 80 is engaged with the proximal end 52P of the waveguide 50 so that it too is centered around the hole 33 in the reflector 20 and extends beyond the infacing surface 27 of the reflector 20. The amplifier 80 receives and amplifies the radio waves once they have been directed into the waveguide 50 by the feed system 65. The amplifier 80 provides for polarization selection and optimization and increases the gain-to-temperature ratio of the satellite signal. The amplifier 80 also provides active summing of the individual antenna elements and increases the systems gain-to-temperature ratio to improve off-the-air reception of local broadcast stations.

The combination VHF-UHF antenna 90 is provided so as to enable reception of local and off-air broadcast TV signals. Thus, the inclusion of the combination antenna eliminates the need and cost to install a separate antenna for local reception which in many cases saves the user from having to subscribe to the local cable service for local television and radio channels. The antenna 90 includes the VHF-UHF means for amplifying 85 (FIG. 1), however such an amplifier may not be needed with sufficient signal reception. The VHF-UHF antenna 90 has up to four leg elements 92. The antenna 90 is shown in FIG. 1 as dashed lines since in this embodiment the antenna legs 92 are mounted in the edges. As illustrated, each one of the leg elements 92 is supported within one of the edges 22,24,26 and 28 of the reflector 20.

As illustrated in FIG. 1, a first protective cover 10 is positioned over the outfacing surface 25 of the reflector 20 so as to keep the reflective subsurfaces 30A–E free of debris while also protecting them from damage or deterioration incurred during long term while also protecting them from damage or deterioration incurred during long term exposure. The cover 10 includes a centrally located hole through which the waveguide 50 extends. The cover 10 is preferably composed of a low dielectric foam material, a substance that is transparent to radio waves, thus allowing the antenna system to function while the cover 10 is positioned over the reflector 20.

Figure 6:
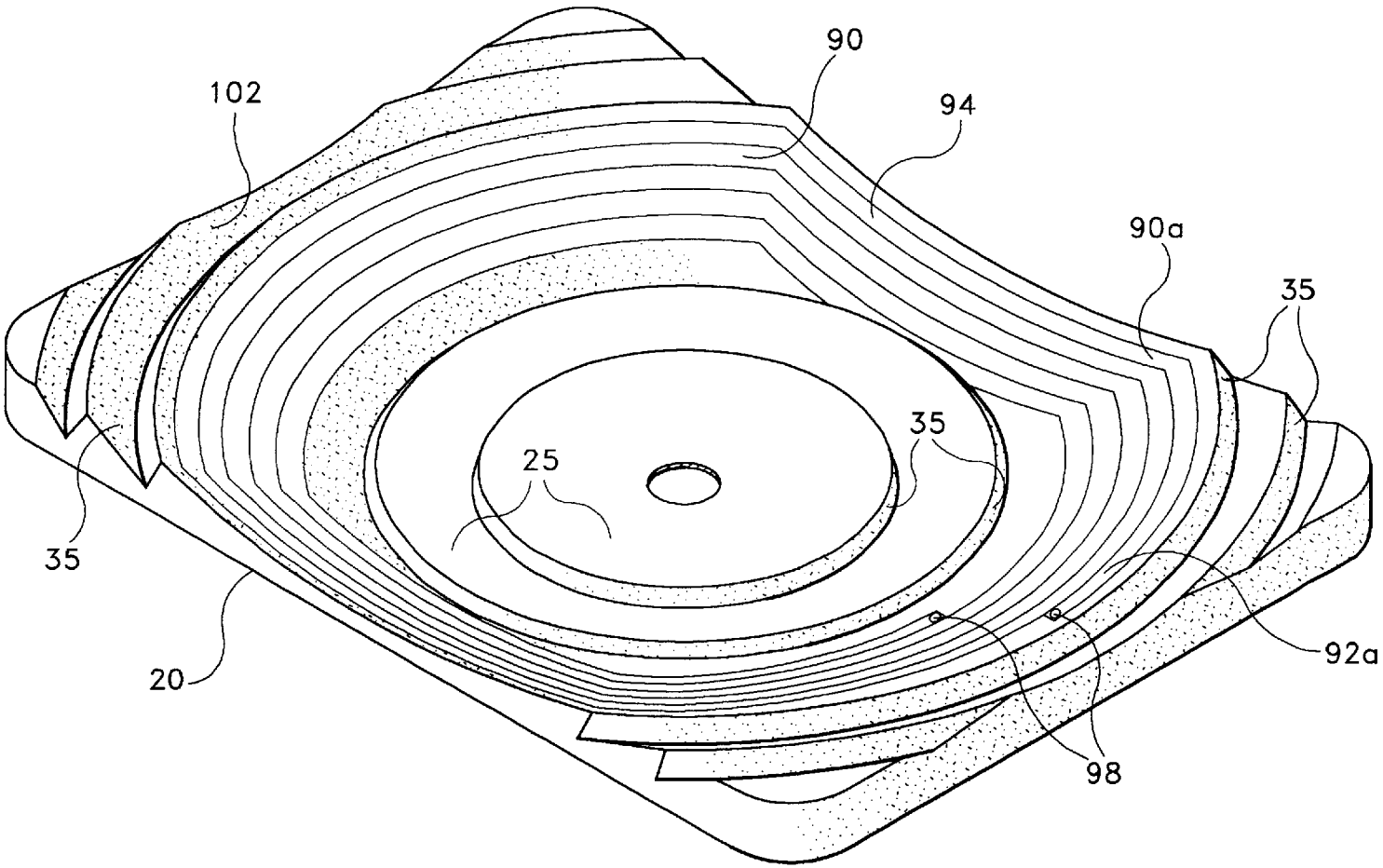
FIG. 6 is a perspective view of a second preferred embodiment of the present invention, particularly showing a relatively flat wave energy reflector having annular steps upon the surface forming concentric parabolic surfaces. Channels formed into the microwave reflecting surface of the reflector form antenna legs for VHF-UHF reception.

FIG. 6 is a perspective view of another preferred embodiment of the present invention, particularly showing a relatively flat rectangular wave energy reflector 20 without 5 a cover 10 having annular steps 35 upon the outfacing surface 25 forming concentric parabolic surfaces. To yield the ability to include spiral leg 92*a* for local VHF-UHF reception, the material forming the satellite wave reflector body 20 is formed from material which will allow omni directional reception by the VHF-UHF antenna leg 92*a* through the reflector body 20 such as fiberglass, plastic or foam material, or combinations thereof, or similar materials which are easily formed using conventional manufacturing processes but substantially rigid in final finished form. Such materials should be substantially transparent to radio waves allowing them to pass through. Using such radio wave transparent materials to form the reflector 20 is especially important to allow for optimum performance of the VHF-UHF antenna 90 formed in the microwave reflective outfacing surface 25 since it allows omni-directional reception of television and radio signals through the body of the reflector 20. Channels or similar voids 94 in the microwave reflecting surface material 102 forming the outfacing surface 25 of the reflector 20 and into the non conductive reflector body portion 20*a* separate the reflecting surface material in a manner to form a spiraling antenna legs 92*a* for VHF-UHF television and radio reception while concurrently allowing the reflective surface to focus incoming satellite radio waves to the required focal point. More legs of differing lengths and dimensions may be formed as needed for reception of desired VHF-UHF signals. Antenna lead wire fasteners 98 of conductive material such as conventional metal screws or coaxial cable mounts or other conventionally used antenna attachments are in electrical communication with the leg 92*a* and offer a point of attachment for antenna or wire leads to capture the VHF-UHF signal from the individual leg 92*a*. The number, dimensions, length, and shape of individual legs 92*a* may be adjusted for optimum reception of desired radio and television frequency reception.

Figure 7:
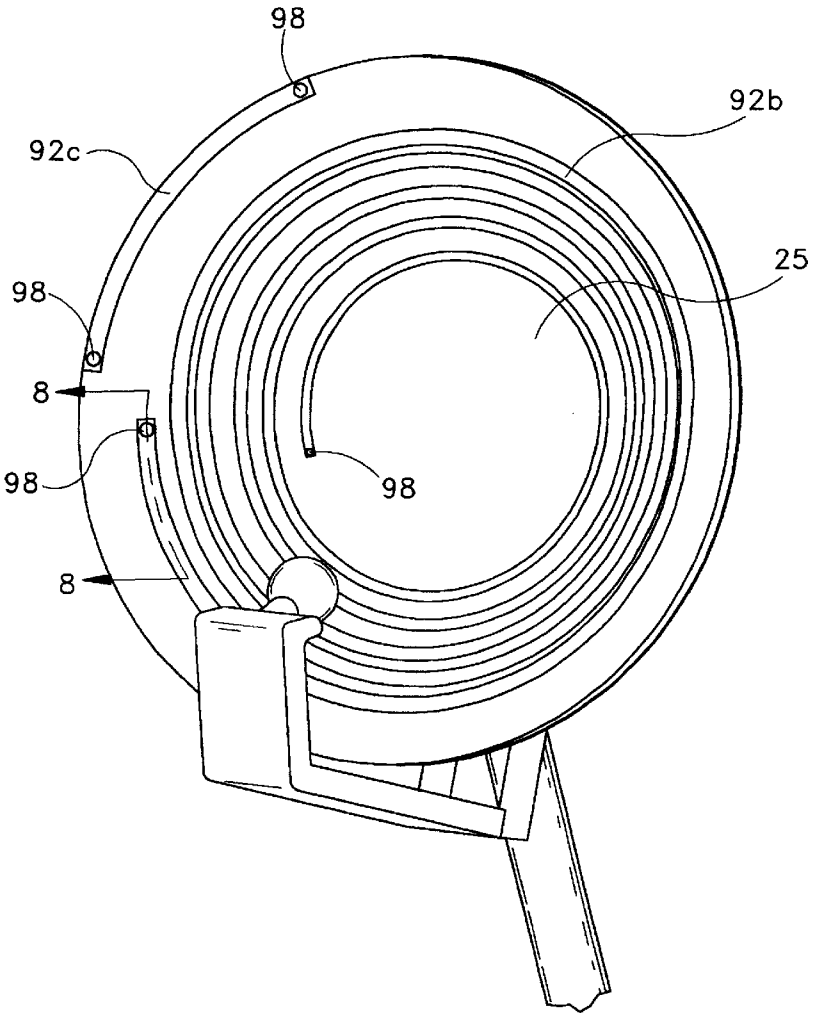
FIG. 7 is a perspective view of a third embodiment of the combination satellite and UHF-VHF antenna picturing a conventional circular shaped parabolic dish antenna having the VHF-UHF antenna formed into the microwave reflecting surface or by the application of the VHF-UHF to the outfacing surface of the reflector using a decal or conventional lamination type application.
Figure 11:
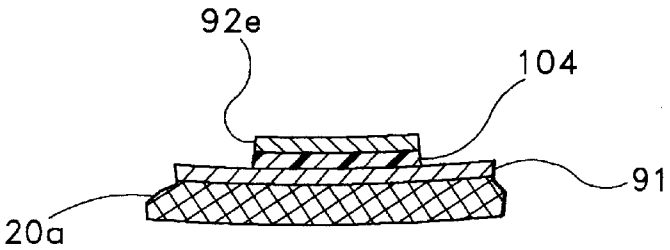
FIG. 11 depicts another sectional view of a VHF-VHF antenna leg having a protective layer upon the weather exposed surface and mounted upon the outfacing surface of a satellite dish antenna using a decal or other method of conventional surface mounting.

FIG. 7 is a perspective view of a conventionally shaped parabolic dish shaped satellite antenna embodiment of the present invention which features a first VHF-UHF antenna leg 92*b* formed into the outfacing surface 25 along with a second such leg 92*c* of a shorter dimension for higher frequencies. As noted earlier, for all embodiments, the number and length of the legs may be varied as needed for desired frequencies.

Unlike current conventionally manufactured parabolic satellite dish antennas which are formed from metal or high or metalized fiberglass material, this embodiment is manufactured using fiberglass, plastic, or foam material, or other conventional materials which are substantially transparent to radio waves but are easily formed to a relatively rigid final shape using conventional molding or other forming processes. Using materials which are transparent to radio waves to form the body of the reflector 20 is especially important to allow for optimum omni directional performance of the VHF-UHF antenna legs 90*a–e*. This is because conventionally manufactured wave reflectors currently in use are metal or metalized plastic and fiberglass or other such transmission blocking material which seriously impairs radio wave reception and operation of the VHF-UHF antenna legs 92*a–d* if not preventing such reception entirely.

When using such radio wave transparent material for the body of the wave reflector 20, a copper or other metalized paint, powder coating, or similar microwave reflective coating is adhered, or otherwise located, upon the outfacing surface 25 to achieve the desired microwave reflection characteristics with concurrent ability to receive radio and television reception in the legs 92*b* formed in the reflective coating by channels formed through the coating into the non conductive satellite body 20*a*. Metalized film, powder coatings, or other microwave reflecting materials can also be adhered to the outfacing surface 25 to achieve microwave reflection. Further, the body of the wave reflector could be formed to accept an inserted and releasably attached outfacing surface with such and insert being formed of reflective material with legs formed therein for reception of VHF-UHF in a desired area. In that manner the body portion could be produced and then customized for certain locations by placing the insert 91 upon the body of the wave reflector to form a customized outfacing surface 25. Such an assembly would allow the reflective surface and leg 92*b* or legs thereon to be changed should the antenna move to a new location where frequency reception requirements of local broadcasts change by simply inserting a new insert 91. Attachment of lead wires to the legs could be accomplished by fittings 98 or flat versions thereof to allow for mounting or by other conventional wire attachment which would run out the side of the insert where it meets the body 20. Consequently differing metalized and other radio wave reflective materials for the outfacing surface and differing manufacturing processes depending on quantity and desired performance are anticipated.

Channels 94 or similar voids formed into the microwave reflecting surface material forming the outfacing surface 25 of reflector 20 define one or a plurality of antenna legs 92 for local off-air VHF-UHF reception while concurrently allowing the reflective outfacing surface 25 of the legs 92 to focus incoming satellite radio waves. Antenna lead wire fasteners 98 of electrically conductive material such as conventional metal screws or coaxial cable mounts or other antenna attachments are in contact with the leg 92 in a conventionally mounted fashion and offer a point of attachment for antenna or wire leads to capture the VHF-UHF signal from the individual legs 92. The VHF-UHF antenna legs 92, can be formed by grooving the microwave reflecting surface material 102, or by the application of a decal having microwave reflective material and desired voids 94 or in strips of microwave reflective material applied with a conventional adhesive application.

Where the reflective outfacing surface 25 is painted or sprayed upon the wave reflector 20 photographic or silk-screen application techniques could also be used in conjunction with the metalized ink or paint used in such a process to form the required channels 94 to yield the desired number and length of legs 90.

Depending upon the material used for the reflective and the number of wave reflectors 20 to be manufactured, many other methods of formation of VHF-UHF antenna legs 92 upon or into the outfacing surface 25 of wave reflector 20 are conventionally available some of which include flame spraying, powder coating, sputtering, vacuum medullization, vapor deposition, E-beam, thermal spray, electrostatic coating, powder spraying, electric arc, wire flame spray, vacuum plasma, thermal evaporation deposit, and vacuum deposit.

Figure 8:
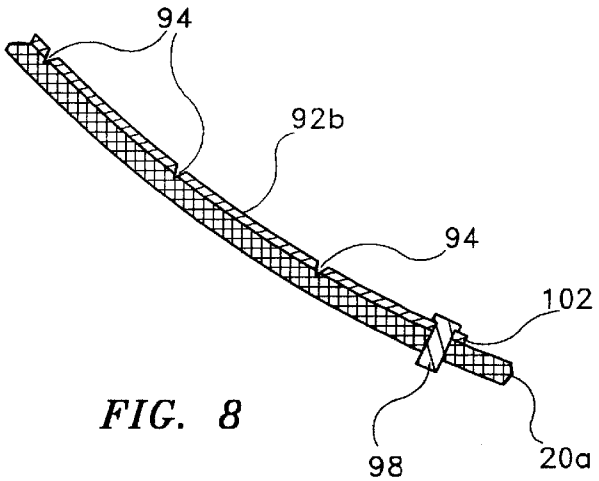
FIG. 8 is a sectional cut away view taken along line 8—8 of FIG. 7 showing the round parabolic style satellite wave reflector with plastic, fiberglass, or other material forming the body of the reflector with separations in the microwave reflecting surface material on the outfacing surface of the reflector to form one or a plurality of local off air antenna legs.

FIG. 8 is a cross section view of a satellite wave reflector 20 of FIG. 7 at line 8—8 showing conventional foam, plastic or other non conductive material forming the body 20*a* of the reflector with channels 94 formed into the microwave reflecting surface 102 in communication with the body portion. As shown, the channel 94 formed into the reflective layer 102 creates one or a plurality of VHF-UHF antenna legs 92*b* and 92*c*. Depending upon the pattern and length of the channels 94 formed into the microwave reflecting surface 102 the number of legs and the and length of the legs may be adjusted to receive the desired wave lengths or radio and television frequencies. An antenna lead wire fastener 98 contacts the leg 92*b* and through an aperture through wave reflector body 20*a* exits on the infacing surface 27 to allow for attachment of antenna lead wires (not shown) such as coaxial cable to communicate the signal from the antenna legs to such devices as low noise amplifiers and receivers down line. Such lead wire fasteners 98 would be used for all legs formed on the antenna. The antenna lead wire fasteners 98 can be conventional screws or coaxial fittings and should be corrosion resistant. They could exit at other points on the wave reflector 20 depending upon number, length and placement of the individual legs on the wave reflector 20.

Figure 9:
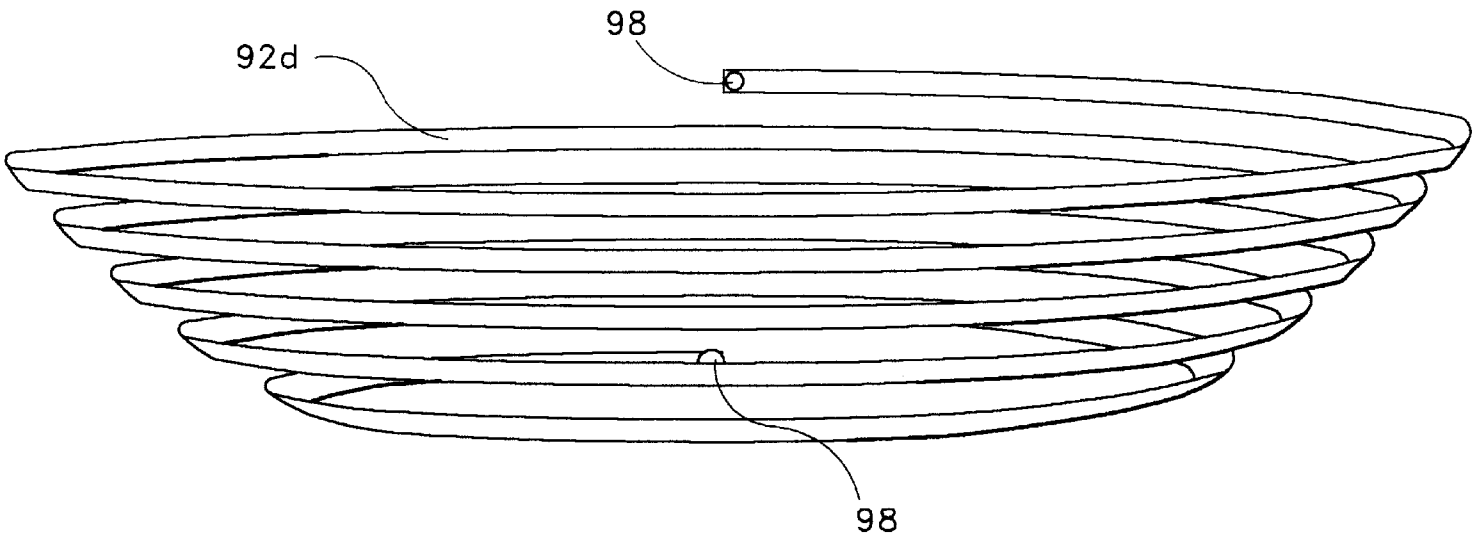
FIG. 9 is an elevational view depicting a spiraling leg of a VHF-UHF antenna formed into the microwave reflecting surface coating on wave reflecting satellite antennas depicting the different planes which the VHF-UHF reception leg occupies upon the face of the microwave reflecting outfacing surface of a parabolic satellite dish antenna.

FIG. 9 is a side view rendering of a spiraling leg 92*d* forming a spiral shaped VHF-UHF antenna in a parabolic shaped dish satellite wave reflector 20. The leg 92*d* is formed by voids or continuous channels 94 placed through the microwave reflecting surface 102 located on the outfacing surface 25 on a conventionally shaped parabolic satellite wave reflector 20 to yield the number, and dimension of legs required for individual applications. It should be noted that because of the use of radio wave transparent material in the forming of the body portion 20*a* of the satellite wave reflector 20 the leg 92*d* achieves excellent omni directional signal reception. Also, because of the natural slope of the parabolic shape of the dish antenna, the leg 92*d* occupies different surface planes upon the outfacing surface 25 as would additional antenna legs if formed in the surface. Since the leg 92*d* receives signals from both sides of the satellite wave reflector 20 due to the material to form the body portion 20*a*, and since the leg 92*d* occupies different planes in the parabolic shape of the wave reflector 20, radio and television reception of the leg 92*d* is omni-directional and minimizes the ghosting and mulipath problems in the received signal. Depending upon the signal frequency reception desired for local radio and television signals, different lengths and dimensions of the leg 92*d* can be formed by channeling the reflecting surface to yield the desired dimensions of one or more legs. For example a short leg 92*d* may be required for UHF frequencies with a longer leg to receive frequencies from 52 Mhz to 830 MHZ. While a leg could be formed on the infacing surface 27 of the wave reflector 20 it would not work as well since signals would be blocked from the microwave reflecting surface from the direction of the outfacing surface 25 much the same as current parabolic dishes with transmission blocking hybrid plastic materials or meatal material in the wave reflector 20.

The depicted legs 92*d* can also be formed by applique, silkscreen, or other methods of placement of a microwave reflective surface with voids defining a leg or legs to the non conductive outfacing surface 25 of the non conductive body 20*a*.

Figure 10:
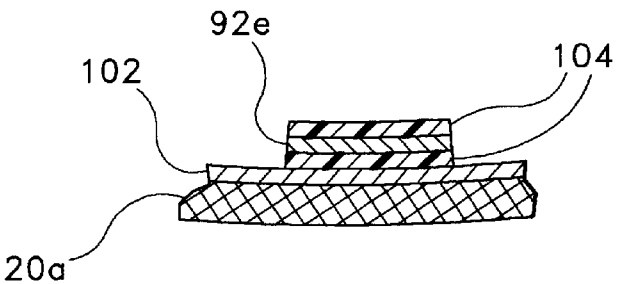
FIG. 10 depicts a sectional view of a leg of a VHF-UHF antenna which is surface mounted upon the outfacing surface of a satellite dish antenna using a decal or conventional surface mounting process.

FIG. 10 depicts a cross section view of another embodiment of the invention where a decal or surface mount of a leg 92*e* of a VHF-UHF antenna which is surface mounted upon the outfacing surface 25 of a satellite wave reflector antenna 20 using a decal or similar conventional surface mounting technique. The decal used in this embodiment features a metalized leg 92*e* sandwiched between two layers of insulating material 104 and mounted to the wave reflector with a conventional decal adhesive. Such a configuration could be used to decal leg 92*e* onto the satellite wave reflector 20 or the reflective coating layer 102 itself could be placed upon the reflector 20 using a decal or a laminate or formed shell, sized and shaped to fit the outfacing surface area and shape. The leg 92*e* can be formed therein by placement of channels 94 or separations in the leg layer 92*e* of the decal with the rest of the reflective outfacing surface 25 formed into the same layer of the decal. However both insulating layers could also be eliminated if a laminate was sized to fit and adhere to the non conductive body 20*a* and form the outfacing surface 25 and adhered upon the body portion 20*a*. This would allow for one model of a satellite wave reflector to be manufactured with the length and spacing and number of the legs 92*e* customized as needed for a particular purpose into a decal or laminate and adhered to the wave reflector body 20*a* to achieve individualized results for differing local reception and frequencies.

While the invention has been described with reference to preferred embodiments, it is to be clearly understood that various substitutions, modifications, and variations may be made by those skilled in the art without departing from the spirit or scope of the invention. Consequently, all such modifications and variations are included within the scope of the invention as defined by the following claims.

What is claimed is:

1. A combined antenna for both satellite and local broadcast reception comprising:

a satellite antenna having an outfacing surface for reflecting radio waves to a focal point; and said outfacing surface carrying a VHF-UHF antenna whereby satellite signals and VHF-UHF signals can be received by a single antenna.

2. The system as defined in claim 1 wherein said VHF-UHF antenna is defined by a plurality of channels in the outfacing surface.

3. The system as defined in claim 2 wherein said VHF-UHF antenna consists of at least one leg defined by said channels in said outfacing surface.

4. The system of claim 2 wherein said plurality of channels formed into the outfacing surface define a plurality of antenna legs.

5. The system of claim 1 wherein said satellite antenna has a body portion and said outfacing surface is mounted thereon.

6. The system of claim 5 wherein said body portion is comprised of material from a group consisting of plastic, fiberglass, ceramic, or mixtures thereof.

7. The system of claim 6 wherein said outfacing surface is metalized paint adhered to said body portion.

8. The system of claim 6 wherein said outfacing surface is a decal adhered to said body portion.

9. The system of claim 6 wherein said outfacing surface is removably attached to said body portion.

10. The VHF-UHF antenna of claim 1 additionally comprising a low noise amplifier.

11. An integrated antenna system comprising:

a parabolic dish shaped reflector having a body portion composed of radio wave transparent material and having an outfacing surface of radio wave reflective material shaped so as to define a common focal point;

a wave guide fixed at a proximal end thereof to the reflector;

a splash plate and a dielectric lens assembly attached at the distal end of the waveguide in a position to intercept radio waves reflected by the reflector toward the focal point, said assembly directing said radio waves and For amplifying same; and a VHF-UHF antenna carried by said outfacing surface.

12. The system as defined in claim 11 wherein said VHF-UHF antenna is defined by a plurality of channels formed into the radio wave reflective material on the outfacing surface of said parabolic dish shaped reflector, said plurality of channels defining at least one antenna leg for VHF-UHF reception in said radio wave reflective material on said outfacing surface.

13. The system of claim 12 wherein said channels formed into said radio wave reflective material on said outfacing surface define a plurality of antenna legs.

14. The system as defined in claim 13 whereby said VHF-UHF antenna is formed by applique of said plurality of antenna legs to said outfacing surface of said reflector using a decal.

15. The system of claim 12 wherein said radio wave reflective material is metalized paint adhered to said outfacing surface.

16. The system of claim 12 wherein said radio wave reflective material is a decal adhered to said outfacing surface.

17. The system of claim 16 wherein said channels are placed in said decal in a manner to define at least one off-the-air antenna leg.

18. An integrated antenna system for satellite and VHF-UHF signal reception comprising:

a round reflector providing a composite outfacing surface shaped to reflect radio waves to a desired focal point;

a dielectric lens assembly in a position to intercept said radio waves reflected by said round reflector toward said focal point, said assembly directing said radio waves and for amplifying same; and a VHF-UHF antenna mounted on said round reflector whereby satellite signals and VHF-UHF signals can be received by a single antenna.

19. The antenna of claim 18 additionally comprising a low noise amplifier.

20. A method of manufacturing a combination satellite and VHF-UHF comprising:

forming an antenna base reflection of satellite signals to focal point;

application of an outfacing surface to said antenna base for reflection of satellite signals to focal point; and forming an antenna onto said outfacing surface capable of reception of telestial electronic signals.

21. The method of claim 20 further comprising:

determining the frequencies desired for reception from said telestial electronic signals;

calculating an optimum dimension and number of antenna legs for reception of desired telestial electronic signals; and forming channels into the radio said outfacing surface sufficient to define said optimum dimension and number of antenna legs therein.

* * * * *